US008727147B2

(12) United States Patent
Kemper et al.

(10) Patent No.: US 8,727,147 B2
(45) Date of Patent: May 20, 2014

(54) BOTTLE ASSEMBLY HAVING BOTTOM VENT

(75) Inventors: Bernard J. Kemper, Bonne Terre, MO (US); Charles H. Miller, Barnhart, MO (US)

(73) Assignee: Handi-Craft Company, St. Louis, MO (US)

( * ) Notice: Subject to any disclaimer, the term of this patent is extended or adjusted under 35 U.S.C. 154(b) by 511 days.

(21) Appl. No.: 12/703,881

(22) Filed: Feb. 11, 2010

(65) Prior Publication Data

US 2011/0192817 A1 Aug. 11, 2011

(51) Int. Cl.
*A61J 9/00* (2006.01)

(52) U.S. Cl.
USPC ..... 215/2; 215/11.1; 215/11.4; 215/11.5; 215/11.6; 215/260; 251/341; 251/279

(58) Field of Classification Search
USPC ..... 215/2, 11.1, 11.4, 11.5, 260, 251, 341, 215/11.6, 279
See application file for complete search history.

(56) References Cited

U.S. PATENT DOCUMENTS

| | | | | |
|---|---|---|---|---|
| 1,854,458 | A | | 4/1932 | Quincy et al. |
| 3,134,495 | A | | 5/1964 | Carbonel |
| D228,694 | S | | 10/1973 | Ritsi |
| 4,010,861 | A | | 3/1977 | Welten |
| 4,401,224 | A | | 8/1983 | Alonso |
| 4,685,577 | A | | 8/1987 | Chen |
| 4,723,668 | A | | 2/1988 | Cheng |
| 4,821,896 | A | | 4/1989 | Cheng |
| 4,828,126 | A | | 5/1989 | Vincinguerra |
| 4,865,207 | A | | 9/1989 | Joyner et al. |
| 4,928,836 | A | | 5/1990 | Wu et al. |
| 5,431,290 | A | | 7/1995 | Vinciguerra |
| 5,456,090 | A | * | 10/1995 | McCoy ..... 62/372 |
| 5,499,729 | A | * | 3/1996 | Greenwood et al. ..... 215/11.5 |
| 5,560,513 | A | * | 10/1996 | Jarrell ..... 220/705 |
| 5,607,074 | A | | 3/1997 | De Gennaro |

(Continued)

FOREIGN PATENT DOCUMENTS

| | | |
|---|---|---|
| CA | 1035728 | 8/1978 |
| EP | 0934052 | 8/1999 |
| EP | 1785126 A2 | 5/2007 |
| WO | 9818427 A1 | 5/1998 |

OTHER PUBLICATIONS

International Search Report and Written Opinion of International Application No. PCT/US2011/024332, dated Apr. 5, 2011, 15 pages.

*Primary Examiner* — Anthony Stashick
*Assistant Examiner* — Cynthia Collado
(74) *Attorney, Agent, or Firm* — Armstrong Teasdale LLP

(57) ABSTRACT

A bottle assembly including a bottle, a top closure member adapted for releasable engagement with a top portion of the bottle, and a bottom closure member adapted for releasable engagement with a base portion of the bottle. The bottom closure member has a base panel with at least one aperture therein. A diaphragm is positionable between the bottom closure member and the base portion. The diaphragm has at least one sealing element for sealingly engaging the base panel of the bottom closure member and an air passage extending through the at least one sealing element. The diaphragm is moveable between a sealed position and an unsealed position. The air passage is configured to inhibit liquid contained within a liquid chamber of the bottle from entering the air passage when the diaphragm is in its sealed position by trapping air within the air passage.

25 Claims, 21 Drawing Sheets

(56) References Cited

U.S. PATENT DOCUMENTS

| | | | | |
|---|---|---|---|---|
| 5,692,627 | A | 12/1997 | Feng | |
| 5,699,921 | A | 12/1997 | Rodriguez | |
| 6,042,850 | A | 3/2000 | Ida et al. | |
| 6,053,342 | A | 4/2000 | Chomik | |
| 6,138,710 | A | 10/2000 | Chomik et al. | |
| 6,209,736 | B1 | 4/2001 | Chen et al. | |
| 6,253,935 | B1 | 7/2001 | Fletcher | |
| 6,290,080 | B1 | 9/2001 | Grosse | |
| 6,446,822 | B1 | 9/2002 | Meyers et al. | |
| 6,601,720 | B2 | 8/2003 | Meyers et al. | |
| D501,929 | S | 2/2005 | Lieberman et al. | |
| D511,385 | S | 11/2005 | Lieberman et al. | |
| 7,163,113 | B2 | 1/2007 | Manganiello et al. | |
| 7,326,234 | B2 | 2/2008 | Lieberman et al. | |
| 7,395,835 | B1 | 7/2008 | Gohlke | |
| 2002/0050481 | A1 | 5/2002 | Manganiello et al. | |
| 2005/0035078 | A1 | 2/2005 | Lieberman et al. | |
| 2006/0273059 | A1 | 12/2006 | Mendenhall et al. | |
| 2007/0045215 | A1* | 3/2007 | Holley et al. | 215/11.4 |
| 2007/0068890 | A1 | 3/2007 | Rohrig | |
| 2007/0181520 | A1 | 8/2007 | Holley, Jr. et al. | |
| 2008/0173612 | A1* | 7/2008 | Renz | 215/260 |
| 2008/0223808 | A1 | 9/2008 | Mendenhall et al. | |
| 2008/0237176 | A1 | 10/2008 | Pillado | |

* cited by examiner

BOTTLE ASSEMBLY HAVING BOTTOM VENT

BACKGROUND

The field of this invention relates generally to bottle assemblies and more particularity to a bottle assembly having a bottom vent.

Bottle assemblies, such as nursing bottle assemblies, typically comprise multiple components including a bottle, a nipple, a collar for securing the nipple to the bottle, and a cap for covering the nipple when the bottle is not in use. The nipple has an opening therein for allowing liquid contained within the bottle to exit the bottle for consumption by an infant or young child. During use, the infant sucks on the nipple to withdraw the liquid contained within the bottle. As a result of the infant sucking and the liquid exiting the bottle, a vacuum is created in the bottle. The vacuum makes it difficult for the infant to suck more liquid from the bottle and can result in the infant ingesting air.

It has long been recognized that the ingestion of air by infants during feeding should be avoided. As a result, some nursing bottle assemblies have incorporated venting means that vent the interior of the bottle to atmosphere during feeding, thereby equalizing pressure in the bottle to reduce the likelihood of the infant ingesting air. However, many of these contain a large number of components making their assembly, disassembly and cleaning somewhat cumbersome and time consuming. Moreover, often times the venting means contains relatively small parts, which are difficult for some users to handle and/or can be easily lost. Moreover, small parts are typically more difficult to clean compared to larger parts.

Furthermore, conventional venting means for nursing bottle assemblies is often difficult for infants to actuate because manufactures are concerned that the venting apparatus may be a potential source of leakage. For example, numerous conventional venting means of nursing bottles contain a valve (e.g., a slit valve) that is movable between an open position for allowing air into the bottle and a closed position for preventing liquid from leaking from the bottle. To minimize the potential leakage, manufacturers often make the force necessary to actuate the valve from its closed position to its open position relatively high thereby rendering it difficult for the infant to actuate the valve by simply sucking on the nipple. This problem is magnified for bottle assemblies having bottom vents as compared to bottle assemblies with side or top vents.

Thus, there is a need for a vented bottle assembly that is relatively easy for an infant to actuate and for a user to disassemble, clean, and reassemble.

BRIEF DESCRIPTION

In one aspect, a bottle assembly having a bottom vent generally comprises a bottle defining a liquid chamber for holding a quantity of liquid. The bottle has an open bottom, an open top, and a sidewall extending between the open bottom and the open top. The sidewall has a top portion, a base portion, and middle portion extending between the top and base portions. A top closure member is adapted for releasable engagement with the top portion of the bottle for closing the open top of the bottle. The top closure member has an opening for allowing liquid held in the liquid chamber to exit the bottle assembly. A bottom closure member is adapted for releasable engagement with the base portion of the bottle for closing the open bottom of the bottle. The bottom closure member has a base panel with at least one aperture therein. A diaphragm is positionable between the bottom closure member and the base portion of the bottle. The diaphragm has at least one sealing element for sealingly engaging the base panel of the bottom closure member and an air passage extending through the at least one sealing element. The diaphragm is exposed to the liquid when liquid is held in the liquid chamber. The diaphragm is moveable between a sealed position wherein the at least one sealing element is sealingly engaged with base panel of the bottom closure member and an unsealed position wherein the sealing element is at least partially disengaged from the base panel of the bottom closure member for allowing air to pass through the air passage of the diaphragm and into the liquid chamber of the bottle. The air passage is configured to inhibit liquid contained within the liquid chamber of the bottle from entering the air passage when the diaphragm is in its sealed position by trapping air within the air passage.

In another aspect, a bottle assembly having a bottom vent generally comprises a bottle defining a liquid chamber for holding a quantity of liquid. The bottle has an open bottom, an open top, and a sidewall extending between the open bottom and the open top. The sidewall has a top portion, a base portion and middle portion extending between the top and base portions. A cap attaches to the top portion of the bottle. A bottom closure member is adapted for releasable engagement with the base portion of the bottle for closing the open bottom of the bottle. The bottom closure member has a base panel with at least one aperture therein. A diaphragm is positionable between the bottom closure member and the base portion of the bottle. The diaphragm has at least one sealing element for sealingly engaging the base panel of the bottom closure member and an air passage extending through the at least one sealing element, the diaphragm being exposed to liquid when liquid is held in the liquid chamber. The diaphragm is moveable between a sealed position wherein the at least one sealing element is sealingly engaged with base panel of the bottom closure member and an unsealed position wherein the at least one sealing element is at least partially disengaged from the base panel of the bottom closure member for allowing air to pass through the air passage of the diaphragm and into the liquid chamber of the bottle. A gap is formed between the diaphragm and the base panel of the bottom closure member. The gap is sized to accommodate deformation of the diaphragm upon freezing of the liquid held in the liquid chamber of the bottle.

In yet another aspect, a method of venting a bottle assembly having a bottom vent generally comprises attaching a bottom closure member to a base portion of a bottle to thereby close an open bottom of the bottle. A diaphragm is captured between the bottom closure member and the base portion of the bottle. The diaphragm has at least one sealing element for sealingly engaging a base panel of the bottom closure member and an air passage extending through the at least one sealing element. A liquid is placed into a liquid chamber of the bottle. A top closure member is attached to a top portion of the bottle to thereby close an open top of the bottle. The top closure member has an opening therein. Liquid is drawn through the opening in the top closure member thereby creating a vacuum within the liquid chamber. The vacuum causes the diaphragm to flex from a sealed position wherein the at least one sealing element is in sealing engagement with the base panel of the bottom closure member to an unsealed position wherein the at least one sealing element is at least partially disengaged from the base panel of the bottom closure member for allowing air to pass through the air passage of the diaphragm and into the liquid chamber of the bottle. As the vacuum within the liquid chamber of the bottle approaches ambient pressure, the diaphragm moves back to the sealed position thereby preventing further air flow into the liquid chamber and trapping air within the air passage of the diaphragm to inhibit liquid contained within the liquid chamber of the bottle from entering the air passage.

In still yet another aspect, a method of storing liquid in a bottle assembly generally comprises attaching a bottom closure member to a base portion of a bottle to thereby close an open bottom of the bottle. A diaphragm is captured between the bottom closure member and the base portion of the bottle. The diaphragm has at least one sealing element for sealingly engaging a base panel of the bottom closure member and an air passage extending through the at least one sealing element. A gap is formed between the diaphragm and the base panel of the bottom closure member. A liquid is placed into a liquid chamber of the bottle. A cap is attached to a top portion of the bottle to thereby close an open top of the bottle. The liquid within the liquid chamber of the bottle is frozen which causes the diaphragm to deflect downward into the air gap and toward the base panel of the bottom closure member.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
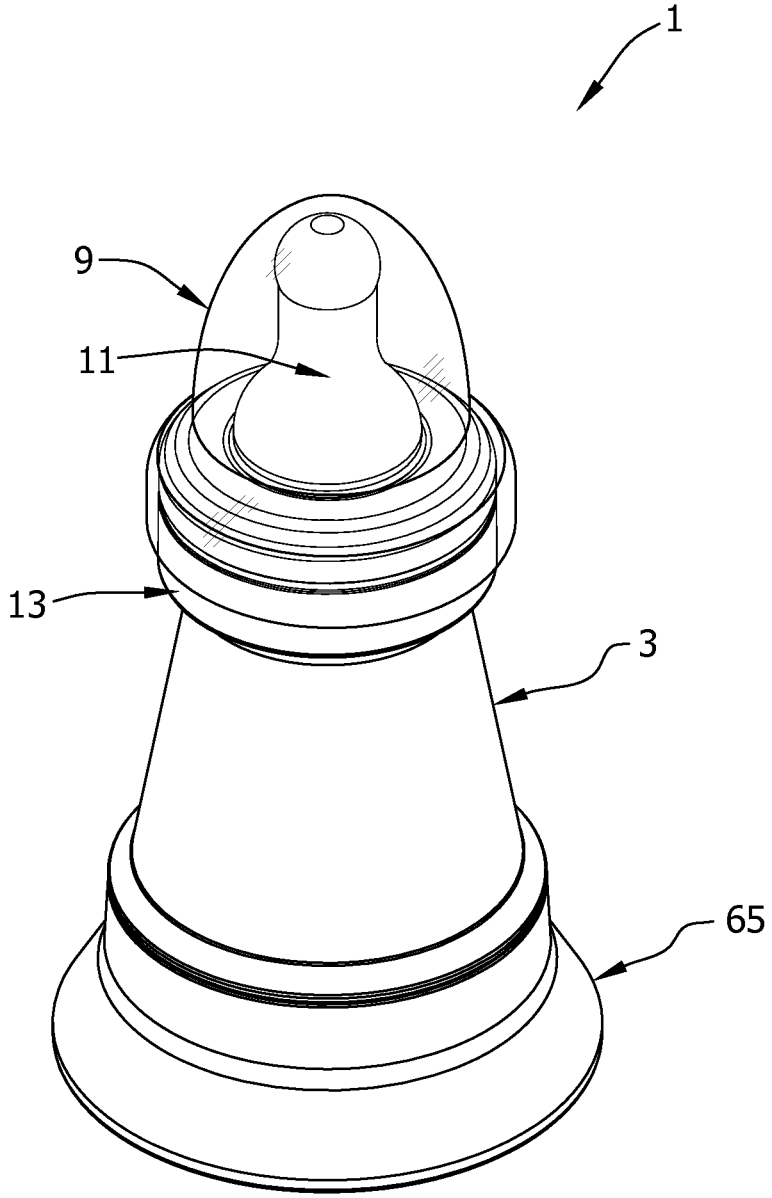
FIG. 1 is a perspective of one embodiment of a bottle assembly having a bottom vent.
Figure 2:
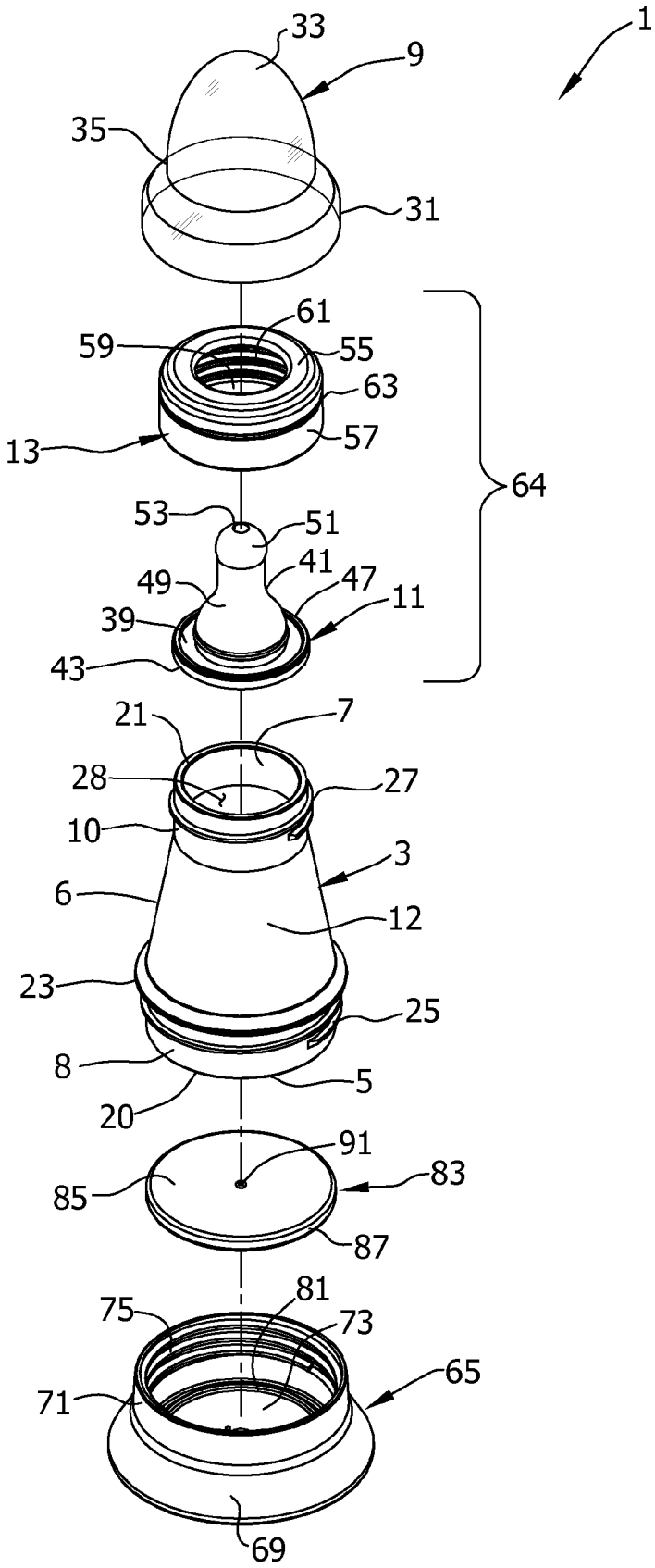
FIG. 2 is an exploded perspective of the bottle assembly.
Figure 3:
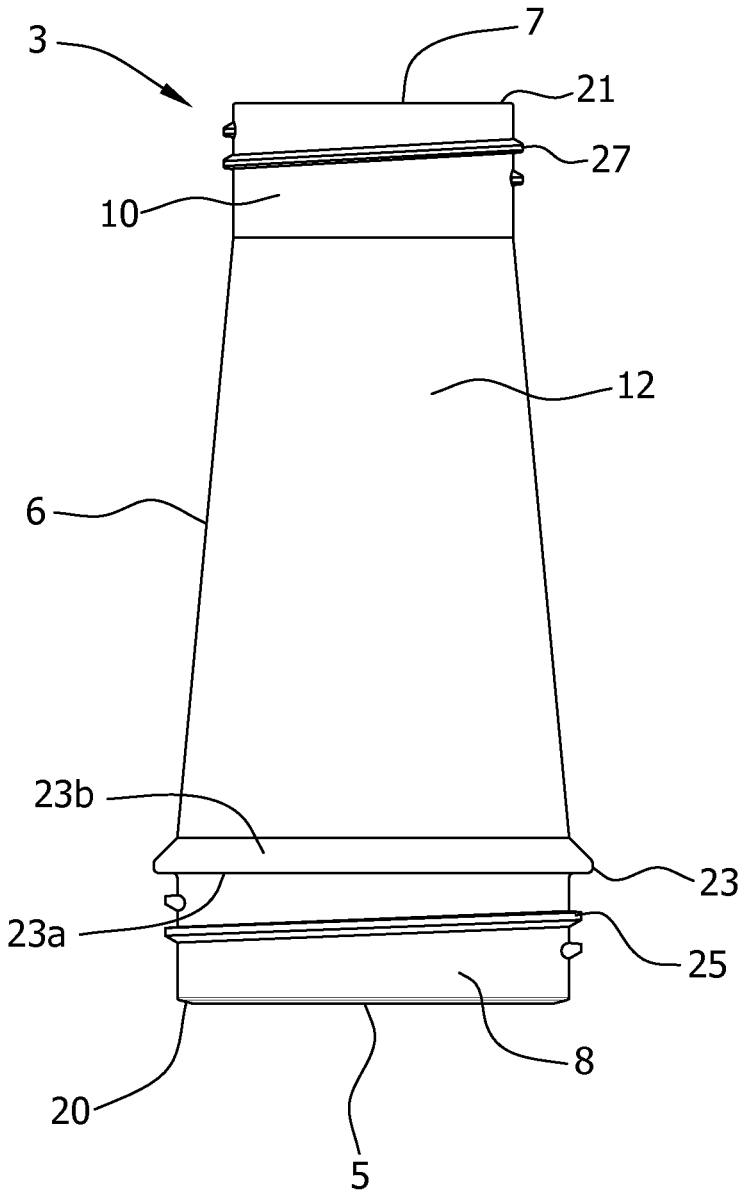
FIG. 3 is a side elevation of a bottle of the bottle assembly.
Figure 4:
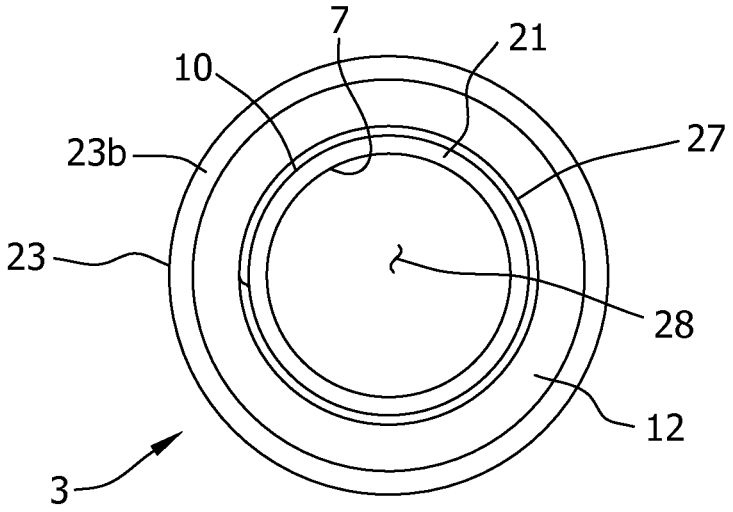
FIG. 4 is a top plan view of the bottle.
Figure 5:
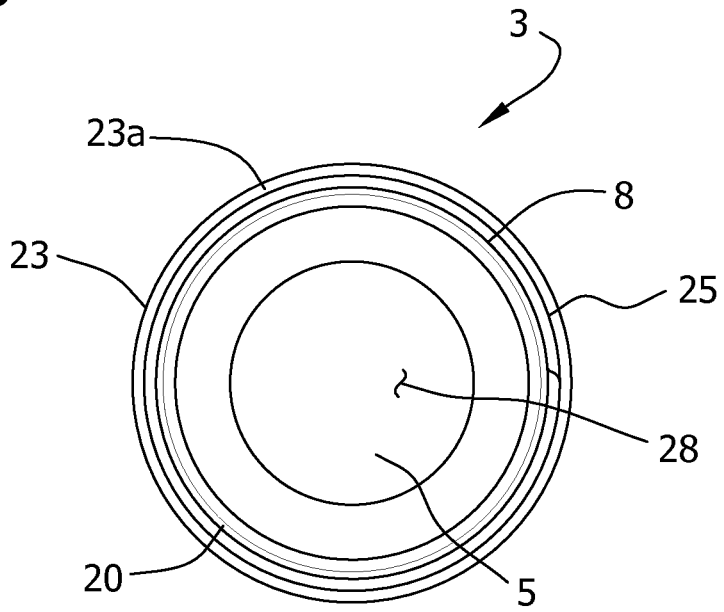
FIG. 5 is a bottom plan view of the bottle.
Figure 28:
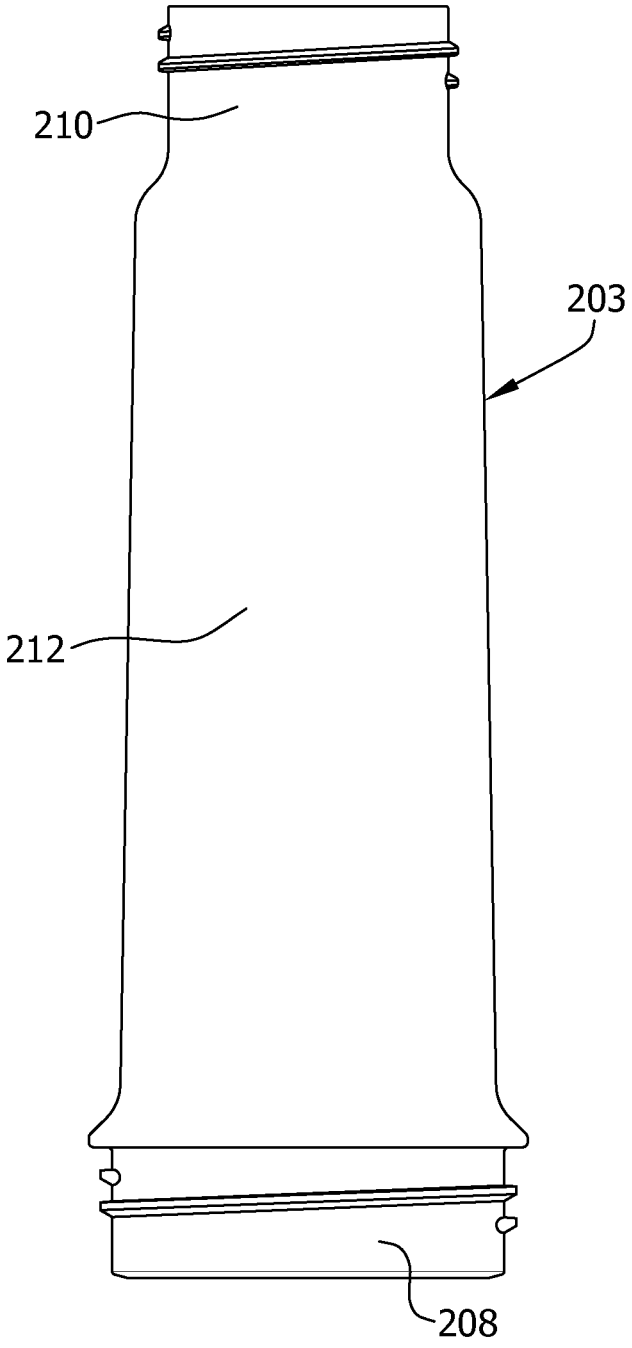
FIG. 28 is a side elevation of another embodiment of a bottle suitable for the bottle assembly.

Referring now to the drawings and in particular to FIGS. 1 and 2, a nursing bottle assembly having a leak resistant bottom vent is indicated generally at 1. The bottle assembly 1 comprises a bottle 3, a cover 9, a nipple 11, and a collar 13. Each of the bottle, cover, nipple, and collar are indicated generally by their respective reference number. The illustrated bottle 3, as best illustrated in FIGS. 2-5, has an open bottom 5, an open top 7, and a generally cylindrical side wall 6 extending between the open bottom and the open top. The cylindrical side wall 6 includes a base portion 8, a top portion 10, and a middle portion 12 extending between the base and top portions. In the illustrated embodiment, the middle portion 12 of the side wall 6 tapers inward as it extends from the base portion 8 to the top portion 10. As a result, the diameter of the middle portion 12 is greater adjacent the base portion 8 than it is adjacent the top portion 10. It is understood that the middle portion 12 of the bottle 3 can be other than tapered such as generally straight, concave, or convex. For example, a bottle illustrated in FIG. 28 and indicated generally at 203 is also suitable for use with the bottle assembly 1. In this embodiment, the bottle 203 has a base portion 208, a top portion 210, and a generally straight middle portion 212.

Figure 29:
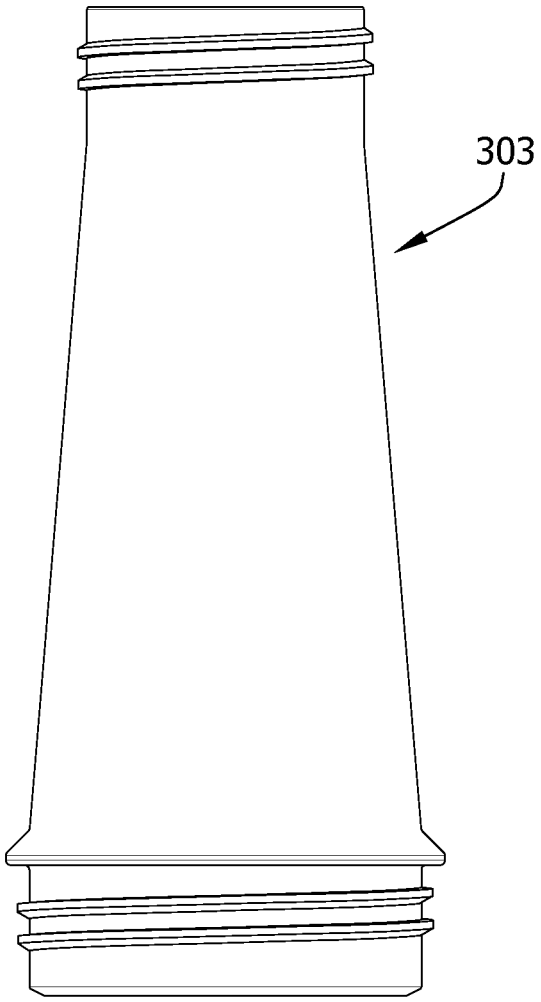
FIG. 29 is a side elevation of yet another embodiment of a bottle suitable for the bottle assembly.

With reference again to FIGS. 2-5, the base portion 8 of the side wall 6 of the bottle 3 is generally cylindrical and includes a circular lower edge 20, an annular rib 23 spaced about the lower edge, and external threads 25 disposed between the lower edge and the annular rib. The annular rib 23 has a generally flat lower surface 23*a* and a sloped upper surface 23*b*. The top portion 10 of the side wall 6 is generally cylindrical and has a circular upper edge 21 and external threads 27 spaced below the upper edge. The illustrated bottle 3 has a liquid chamber 28 adapted to hold a quantity of liquid for consumption by a user, such as an infant or a young child. More specifically, the illustrated bottle 3 is adapted for use by a baby or infant and to hold approximately 2 ounces of liquid (e.g., breast milk, formula, water). The bottle 3 can be made of any suitable material (e.g., plastic, glass, stainless steel, aluminum) and can be made in any desired color or colors, and may be transparent, translucent, or opaque. In one suitable embodiment, the bottle 3 is made from plastic and manufactured using an injection mold process, which provides greater control over the thickness of the bottle as compared to a blown mold process. It is understood that the bottle 3 can have different configurations than those illustrated herein (e.g., a sports bottle, a travel cup, a training or sippy cup) and sized to hold quantities of liquid besides 2 ounces (e.g., 4 ounces, 6 ounces, 9 ounces, etc.). For example, FIG. 29 illustrates a bottle, indicated generally at 303, that is sized to hold approximately 4 ounces of liquid.

Figure 6:
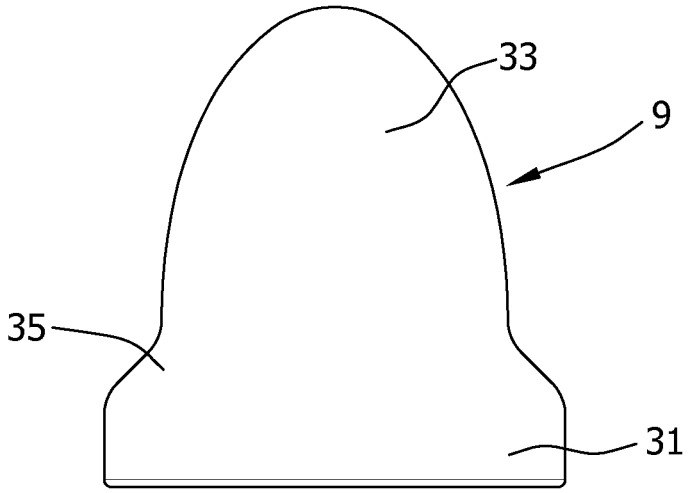
FIG. 6 is a side elevation of a cover of the bottle assembly.
Figure 7:
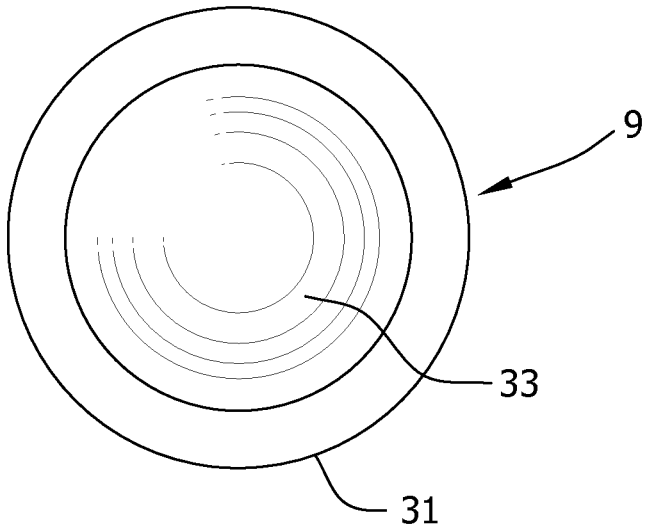
FIG. 7 is a top plan view of the cover.
Figure 8:
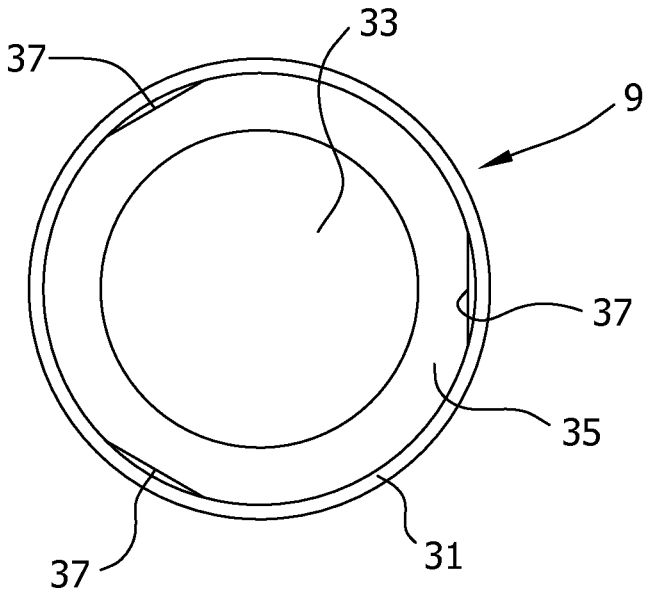
FIG. 8 is a bottom plan view of the cover.

The cover 9, which is illustrated in FIGS. 6-8, is removeably securable to the collar 13 (FIGS. 1 and 2) via a snap-fit connection but it is understood that other types of suitable connections can be used (e.g, a threaded connection). As best seen in FIG. 6, the cover 9 has a lower cylindrical portion 31, a domed upper portion 33, and a sloped intermediate or transition portion 35 that extends between the lower portion and the upper portion. In the illustrated embodiment, the lower portion 31 has three inward extending tabs 37 adapted for releasable snap-fit connection with the collar 13. The three tabs 37 can be seen in FIG. 8. As a result, the cover 9 can be selectively secured to the collar 13 during periods of non-use (e.g., storage, travel) to cover the nipple 11 (FIGS. 1 and 2) and removed during periods of use for providing access to the nipple. The cover 9 can be made of any suitable material, such as polypropylene, and can be made in any desired color or colors, and may be transparent (as illustrated), translucent, or opaque. It is contemplated that the cover 9 can be omitted from the bottle assembly 1. It is understood that the cover 9 can have more or fewer tabs 37 than the three seen in the illustrated embodiment.

With reference to FIGS. 2 and 9-11, the nipple 11 includes a base portion 39 and a nipple portion 41 that extends up from the base portion. The base portion 39 comprises an annular flange having a generally circular outer edge 43 and a generally circular inner edge 45. In the illustrated embodiment, a continuous, peripheral lip 47 projects up from the flange generally adjacent the circular outer edge 43 of the base portion 39. It is understood that the peripheral lip 47 can be discontinuous (i.e., formed from two or more discrete segments) or even omitted from the base portion 39.

Figure 9:
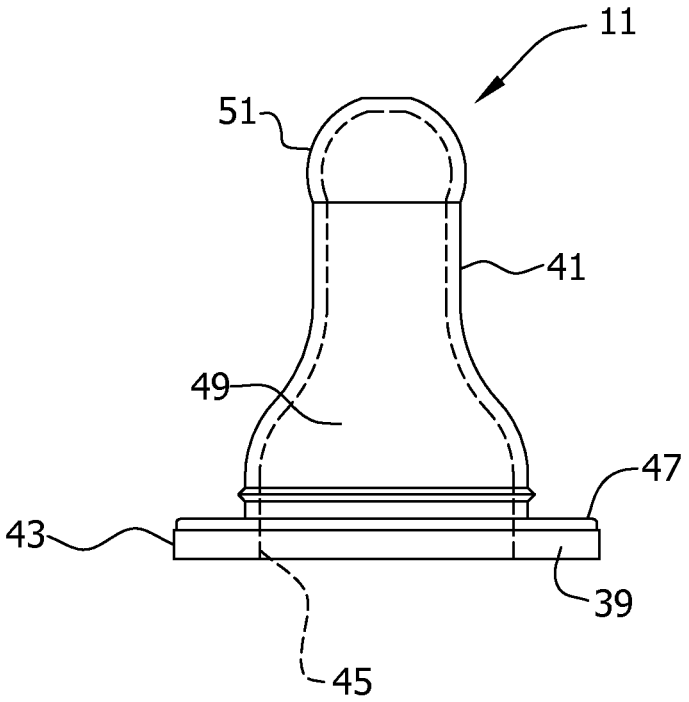
FIG. 9 is a side elevation of a nipple of the bottle assembly.
Figure 10:
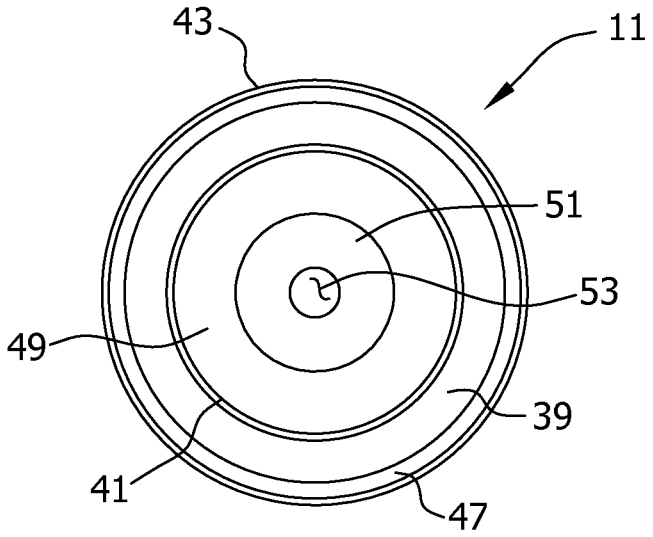
FIG. 10 is a top plan view of the nipple.
Figure 11:
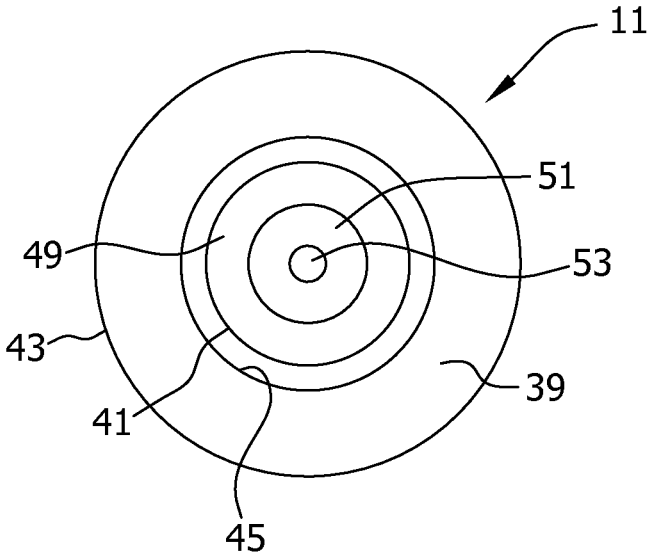
FIG. 11 is a bottom plan view of the nipple.

The nipple portion 41 of the nipple 11 extends up from the base portion 39 generally adjacent the circular inner edge 45 thereof. As seen in FIG. 9, the nipple portion 41 includes a contoured tubular sidewall 49 and a generally bulbous end 51 having an opening 53 therein. The illustrated bulbous end 51 has one generally circular opening 53 therein but it is understood that more openings can be provided in the bulbous end and that the openings can have one or more different shapes (e.g., square, triangle, oval, slits) without departing from the scope of this invention. It is recognized that the fluid flow rate from the bottle assembly 1 during use can be altered by varying the size and/or number of openings 53 in the bulbous end 51 of the nipple 11.

The illustrated nipple 11 is made from a thin, pliant material such as rubber, silicone, or latex. It is contemplated, however, that the nipple can be made from any suitable material. The nipple 11 is suitably transparent but it is understood that it can be translucent or even opaque.

Figure 12:
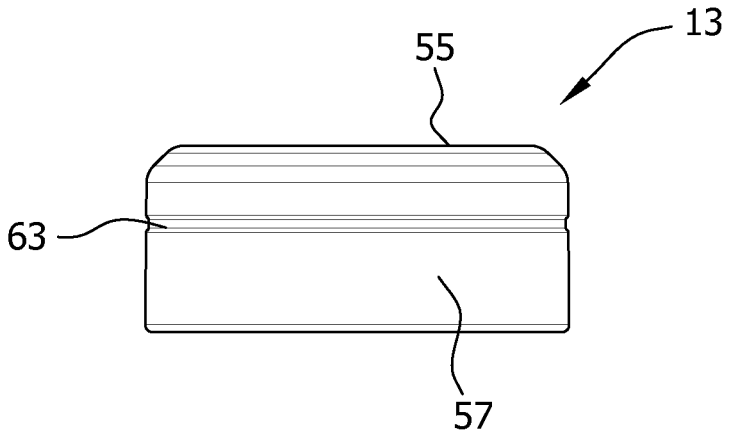
FIG. 12 is a side elevation of a collar of the bottle assembly.
Figure 13:
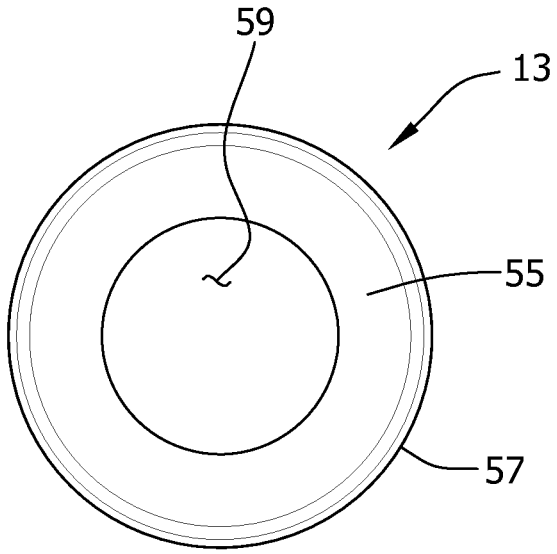
FIG. 13 is a top plan view of the collar.
Figure 14:
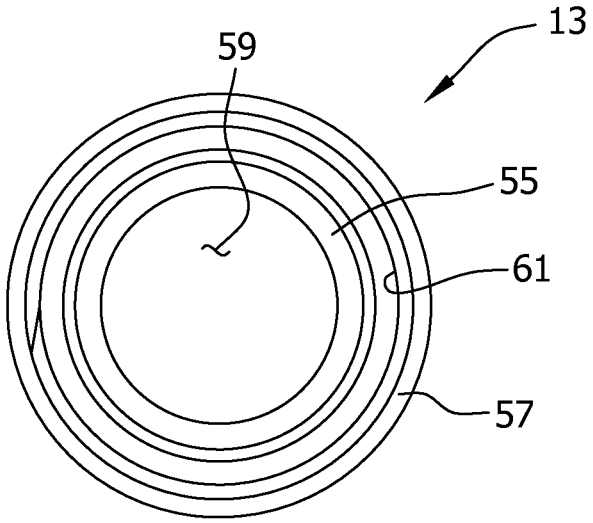
FIG. 14 is a bottom plan view of the collar.
Figure 15:
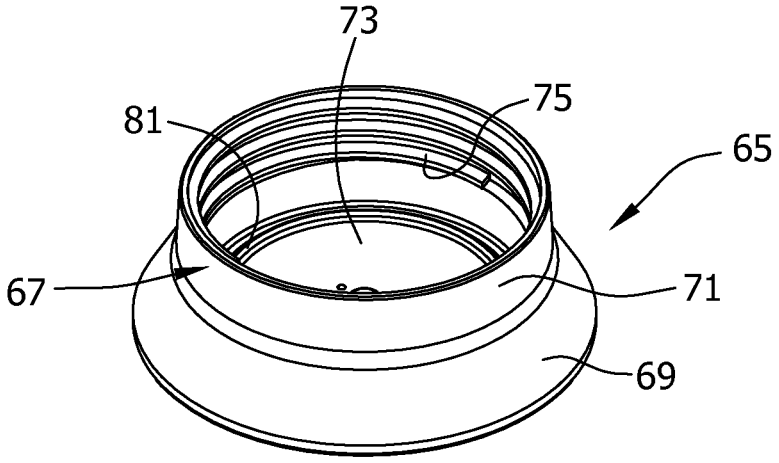
FIG. 15 is a perspective of a bottom closure member of the bottle assembly.
Figure 16:
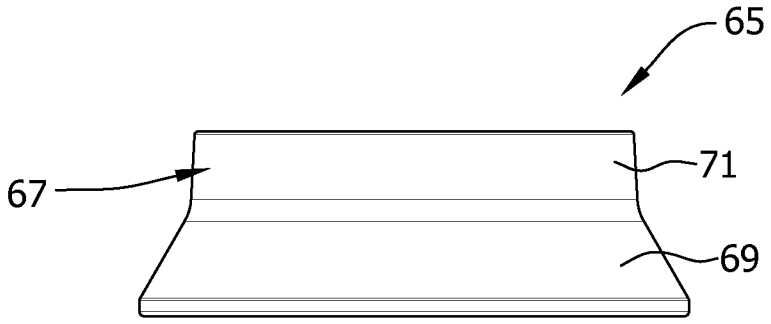
FIG. 16 is a side elevation of the bottom closure member.

Reference now to FIGS. 12-14, the collar 13 includes a generally flat upper portion 55 and a cylindrical skirt 57 depending downward from the upper portion. The upper portion 55 includes a generally circular opening 59 therein for allowing the nipple portion 41 of the nipple 11 to pass through the collar 13 as illustrated in FIG. 1. As seen in FIG. 14, the skirt 57 includes internal threads 61 that are adapted for mating with the external threads 27 (FIG. 2) of the top portion 10 of the bottle 3 for selectively securing the collar 13 and the nipple 9 to the bottle assembly 1. With reference to FIG. 12, the collar 13 also includes an external channel 63 sized for receiving the tabs 37 of the cover 9 when the cover is secured thereto. The tabs 37 of the cover 9 and the channel 63 of the collar 13 collectively define the snap-fit connection therebetween.

In the illustrated embodiment, the nipple 11 and the collar 13 collectively define a top closure member, indicated generally at 64, for closing the open top 7 of the bottle 3 (FIG. 2). It is contemplated, however, that the top closure member 64 can have a different configuration than that illustrated herein. For example, the top closure member 64 can have any configuration suitable for used with, e.g., a nursing bottle, a sports bottle, a travel cup, a training cup, and/or a sippy cup.

Referring briefly to FIGS. 1 and 2, the bottle assembly 1 further comprises a bottom closure member 65 for closing the open bottom 5 of the bottle 3. As seen in FIGS. 15-18, the bottom closure member 65 includes a generally cup-shaped socket, indicated generally at 67, and a tapered foot 69 extending downward and outward from the socket. The tapered foot 69 provides a stable base for the bottle assembly 1 when the bottle assembly is placed on a generally flat surface (e.g., a counter top, a table, a freezer tray) to thereby inhibit tipping of the bottle assembly.

Figure 17:
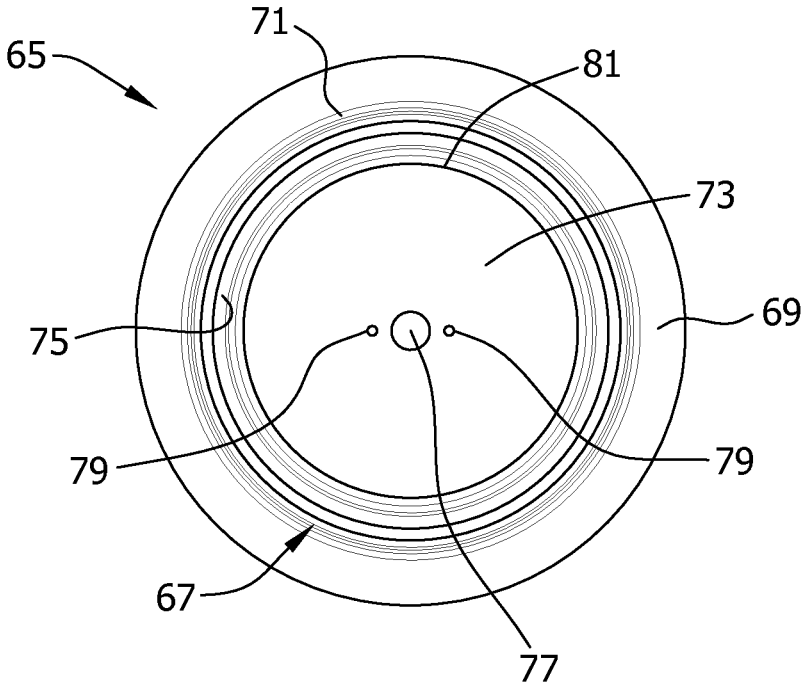
FIG. 17 is a top plan view of the bottom closure member.
Figure 18:
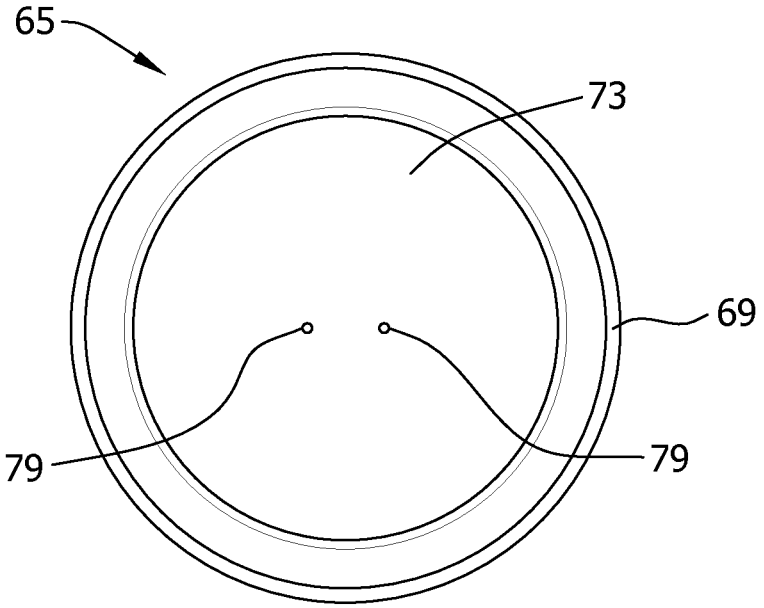
FIG. 18 is a bottom plan view of the bottom closure member.
Figure 19:
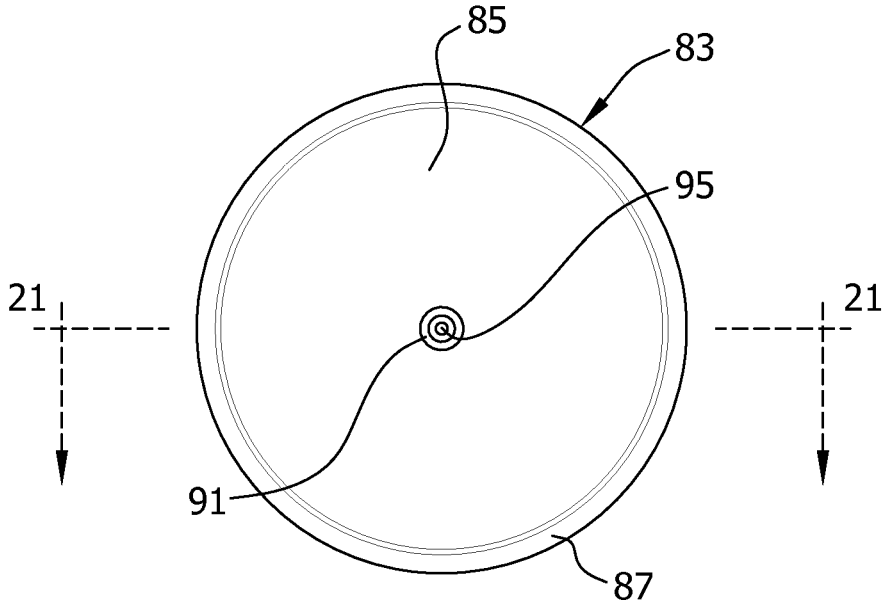
FIG. 19 is a top plan view of a diaphragm of the bottle assembly.
Figure 20:
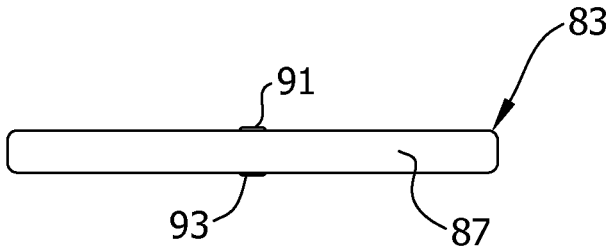
FIG. 20 is a side elevation of the diaphragm.

The cup-shaped socket 67 includes a cylindrical wall 71 and a base panel 73 closing a bottom end of the cylindrical wall. The cylindrical wall 71 has internal threads 75 for mating with the external threads 25 (FIG. 2) on the base portion 8 of the bottle 3. Accordingly and as explained in more detail below, the bottom closure member 65 can be selectively coupled to and selectively decoupled from the bottle 3 via the threaded connection therebetween. As seen in FIG. 17, the base panel 73 has a centrally located circular seat 77, two circular apertures 79 located adjacent the seat, and an annular shoulder 81. While the seat 77 in the illustrated embodiment is circular, it is understood that the seat can have other shapes (e.g., square, hexagonal). It is also understood that, in some suitable embodiments, the seat 77 can be omitted. It is further understood that the apertures 79 can have shapes other than circular and that more or fewer apertures can be located in the base panel 73. The annular shoulder 81 is disposed on an upper surface of the base panel 73 at a location generally adjacent to and transversely inward from the cylindrical wall 71. In the illustrated embodiment, the base panel 73 is generally flat but it is understood that the base panel could have other suitable shapes (e.g., conical, frustum, domed). It is also understood that the base panel 73 can include suitable reinforcing members (e.g., ribs).

Figure 21:
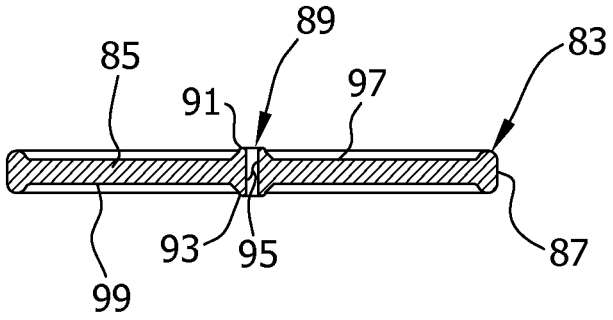
FIG. 21 is a cross-section taken along line 21-21 of FIG. 19.

With reference now to FIGS. 19-22 (and in particular to FIG. 22), the bottle assembly 1 further comprises a diaphragm, indicated generally at 83, disposed between the bottom edge 20 of the bottle 3 and the bottom closure member 65. The diaphragm 83 closes the open bottom 5 (FIG. 2) of the bottle 3. The diaphragm 83 has a roughly disk-shaped portion 85, an annular rim 87 circumscribing the disk-shaped portion, and a central seating member, indicated generally at 89. The central seating member 89 comprises first and second sealing elements 91, 93 that project outward from the disk-shaped portion 85, and a central air passage 95 that extends axially through the diaphragm 83. As seen in FIG. 21, each of the first and second sealing elements 91, 93 of the diaphragm 83 are generally frustum and coaxially aligned with the air passage 95 and each other. As a result, the air passage 95 extends through each of the first and second sealing elements 91, 93. The diaphragm 83 is symmetric in that it has a first side 97 and a substantially identical second side 99 (FIG. 21). As a result, the diaphragm 83 is positionable in the bottom closure member 65 with either side 97, 99 facing up.

Figure 22:
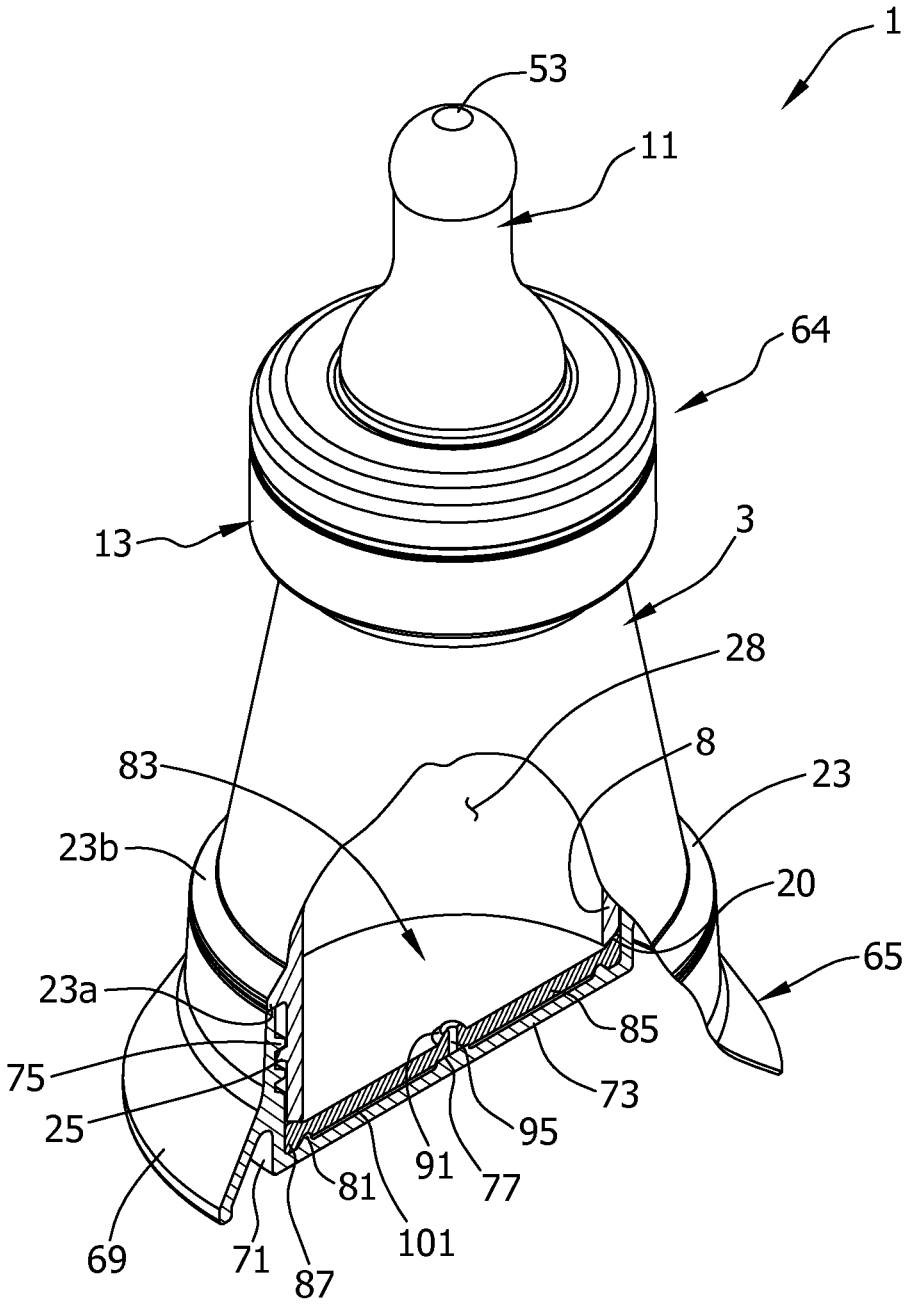
FIG. 22 is a fragmentary perspective of the bottle assembly with portions broken away to show the diaphragm in a sealed position with respect to the bottom closure member.
Figure 23:
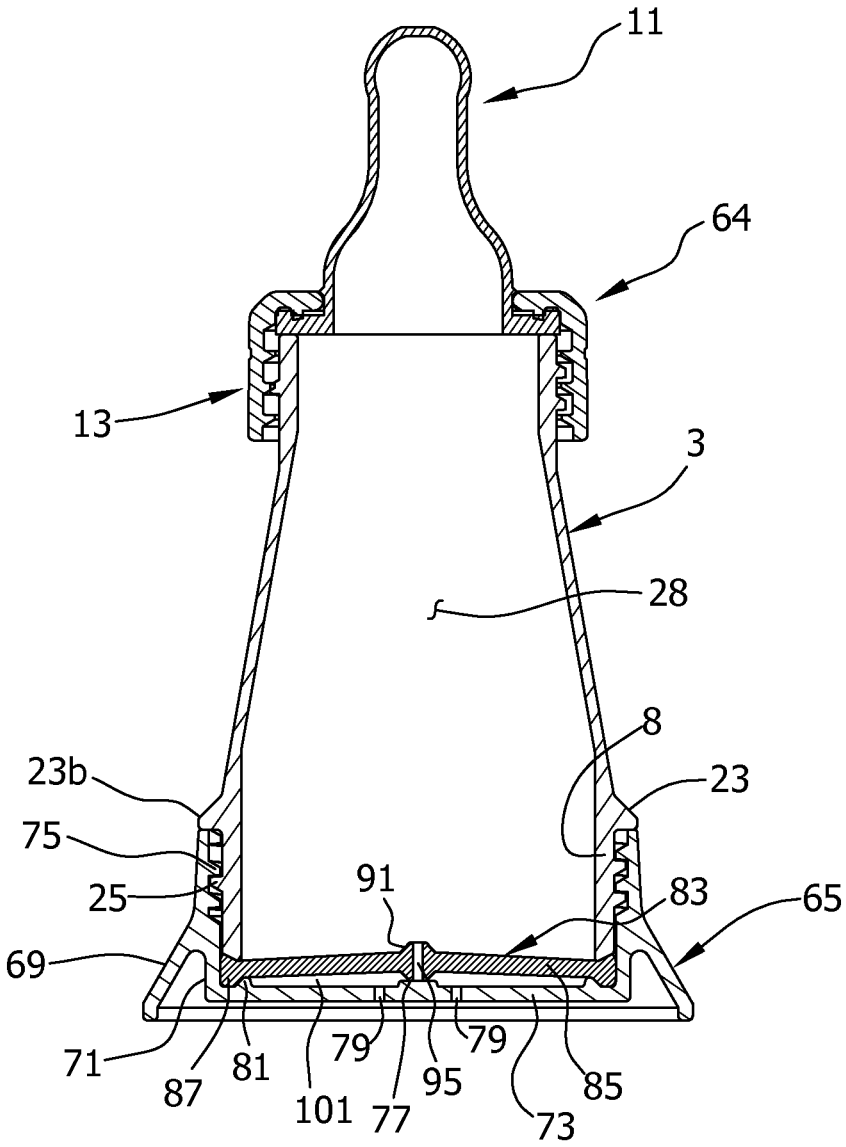
FIG. 23 is vertical cross-section of the bottle assembly showing the diaphragm in the sealed position with respect to the bottom closure member.

As illustrated in FIGS. 22 and 23, the diaphragm 83 is captured between the bottom closure member 65 and the base portion 8 of the bottle 3. More specifically, the diaphragm 83 is inserted into the cup-shaped socket 67 (FIG. 15) of the bottom closure member so that one of the first and second sealing elements 91, 93 rest on the seat 77 of the base panel 73 of the bottom closure member 65 and the annular rim 87 of the diaphragm is disposed adjacent a lower portion of the cylindrical wall 71 outward of the annular shoulder 81 of the bottom closure member. The bottom closure member 65 is screwed onto the bottle 3 via the interior threads 75 of the bottom closure member and the external threads 25 of the lower portion 8 on the bottle. In doing so, the lower edge 20 of the bottle 3 engages a portion of the diaphragm 83 at a location generally opposed to the annular shoulder 81 of the bottom closure member to thereby pinch the diaphragm between the bottle and the bottom closure member to form a liquid tight seal. As seen in FIG. 23, an air gap 101 is formed between the diaphragm 83 and the base panel 73 of the bottom closure member 65. Moreover, the diaphragm 83 is slightly bowed upward at its center when it is captured between the bottom closure member 65 and the bottle 3. This causes the diaphragm, which is resilient, to be biased toward the base panel 73 of the bottom closure member 65. More specifically, bowing the diaphragm 83 upward at its center causes one of the first and second sealing elements 91, 93 to be biased against the seat 77 of the base panel 73 of the bottom closure member 65

The bottle assembly 1 can be repeatedly taken apart for thorough cleaning (FIG. 2) and reassembled for the next use (FIG. 1). The separable components of the bottle assembly 1 are all relatively large so that they are easy to handle, are not easily lost, and pose a reduced risk of danger to small children. In addition, the number of separable components is minimized to make assembly and reassembly of the bottle assembly 1 relatively easy.

As mentioned above, the cover 9 can be selectively removed from the bottle assembly 1 via its snap-fit connection with the collar 13. Thus, a user of the bottle assembly can remove the cover 9 by manually pulling the cover off of the collar 13. The collar 13 can be removed from the bottle assembly 1 by disengaging the threaded connection between the collar and the bottle 3. More specifically, the collar 13 can be manually rotated with respect to the bottle 3 to thereby disengage the internal threads 61 of the collar from the external threads 27 of the top portion 10 of the bottle 3. Since the nipple 11 is captured by the collar 13, removal of the collar from the bottle assembly 1 results in removal of the nipple as well. The bottom closure member 65 can also be manually rotated with respect to the bottle 3 to thereby disengage internal threads 75 from the external threads 25 on the base portion 8 of the bottle 3. Since the diaphragm 83 is captured by the bottom closure member 65, removal of the bottom closure member from the bottle assembly 1 results in removal of the diaphragm as well. Once the bottom closure member 65 and diaphragm 83 are disengaged from the bottle 3, the diaphragm 83 can be manually lifted from the bottom closure member 65. Otherwise, the bottom closure member 65 can be turned upside down and the diaphragm 83 will fall out.

Thus, all of the components of the illustrated bottle assembly 1 can be easily separated and cleaned either manually or in a dishwasher. The bottle assembly 1 can be easily reassembled by reversing the disassembling process.

Figure 24:
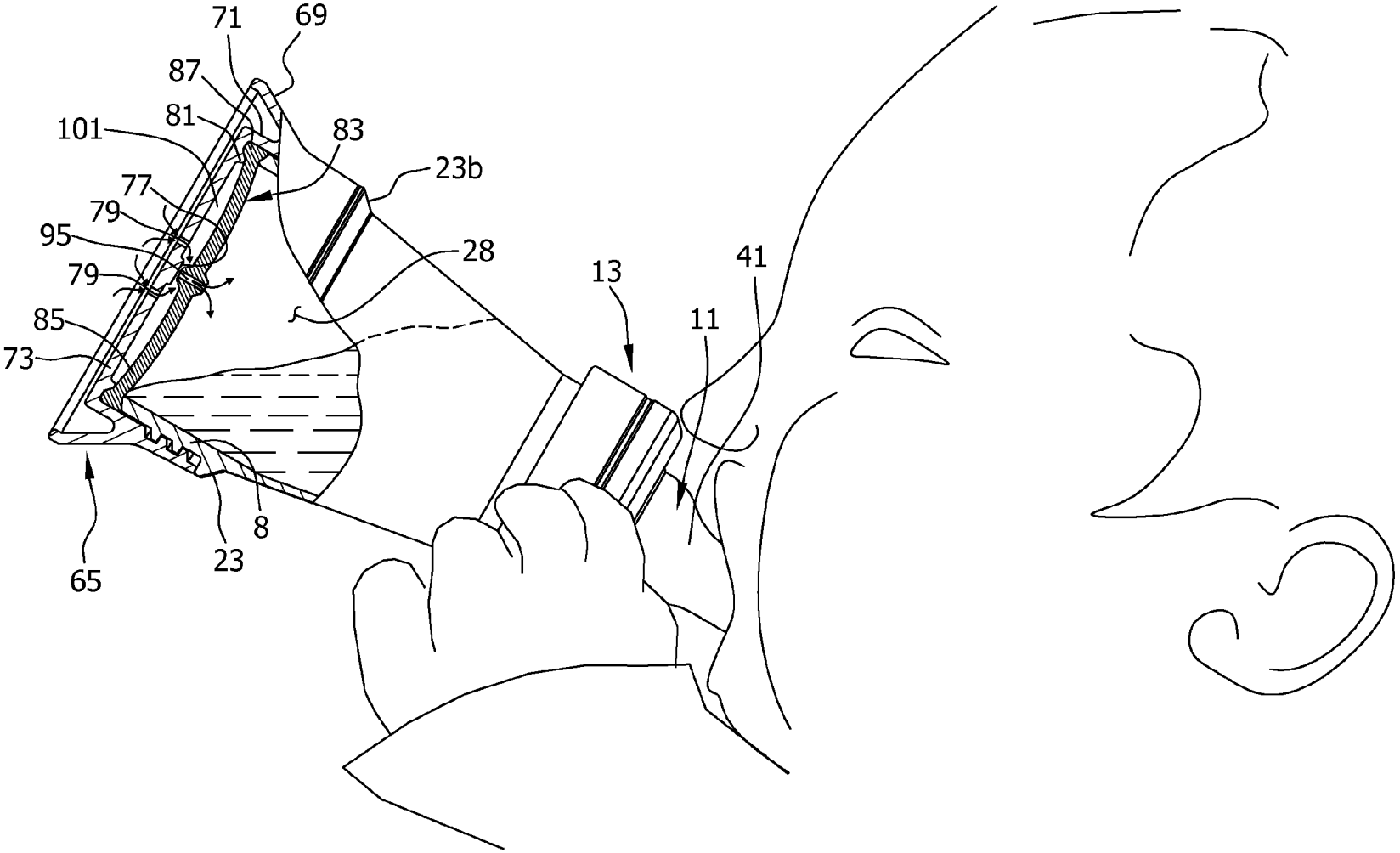
FIG. 24 is a fragmentary perspective of the bottle assembly with portions broken away to show a liquid therein and the diaphragm in an unsealed position with respect to the bottom closure member, the bottle assembly being shown tilted to a drinking position by an infant.

As illustrated in FIG. 24, an infant or young child can drink from the bottle assembly 1 by placing his/her lips around the around the nipple portion 41 of the nipple 11 to form a seal therewith, tilting the bottle assembly to a drinking position thereby causing liquid to flow via gravity into the nipple, and sucking so that liquid (e.g., milk, formula, water) contained in the liquid chamber 28 of the bottle 3 is drawn through the opening 53 in the bulbous wall 51 of the nipple, and into the infant's mouth. Sucking on the nipple 11 and removing liquid from the liquid chamber 28 of the bottle 3 causes a vacuum to form within the liquid chamber. That is, the infant drinking liquid from the bottle assembly 1 causes the pressure within the liquid chamber 28 of the bottle 3 to drop below ambient pressure. In one suitable embodiment, more than 50% of the surface area of the first side 97 of the diaphragm 83 is subjected to the vacuum within the bottle 3 and more than 50% of the surface area of the second side 99 of the diaphragm is subjected to ambient pressure during use. Suitably more than 75% and even more suitably more than 90% of the surface areas of the first and second surfaces are subjected to vacuum and ambient pressure, respectively, during use. As a result, the diaphragm 83 is responsive to relatively low pressure differentials (i.e., the pressure difference between the liquid chamber 28 of the bottle 3 and ambient pressure) thereby making it easy for the infant to drink from the bottle assembly 1. In one suitable embodiment, the diaphragm 83 is responsive to pressure differentials between about 2 and about 4 inches of water. However, it is understood that the diaphragm 83 can be responsive to other ranges of pressure differentials.

The vacuum formed within the liquid chamber 28 of the bottle 3 draws the diaphragm 83 to move from a sealed position (FIG. 25) to an unsealed position (FIG. 24). More specifically, the vacuum causes the diaphragm 83 to flex away from the base panel 73 of the bottom closure member 65 thereby opening an air vent and allowing air (as indicated by the arrows in FIG. 24) into the liquid chamber 28 of the bottle 3. Particularly, flexure of the diaphragm 83 repositions the outer facing one of the first and second sealing elements 91, 93 away from the seat 77 of the base panel 73 of the bottom closure member 65 to allow air to flow in through two apertures 79 in the base panel of the bottom closure member, into the air gap 101 formed between the diaphragm 83 and bottom closure member, through the air passage 95 in the diaphragm, and into the liquid chamber 28 of the bottle 3. As the vacuum pressure within the liquid chamber 28 of the bottle 3 approaches ambient pressure, the resiliency of the diaphragm 83 causes it to move back to the sealed position thereby preventing further air flow into the liquid chamber. Particularly, the outer facing one of the first and second sealing elements 91, 93 of the diaphragm 83 return to the seated position wherein the respective sealing element sealingly engages the seat 77 of the base panel 73 of the bottom closure member 65 and thereby blocks air flow into the liquid chamber 28 of the bottle 3.

Figure 25:
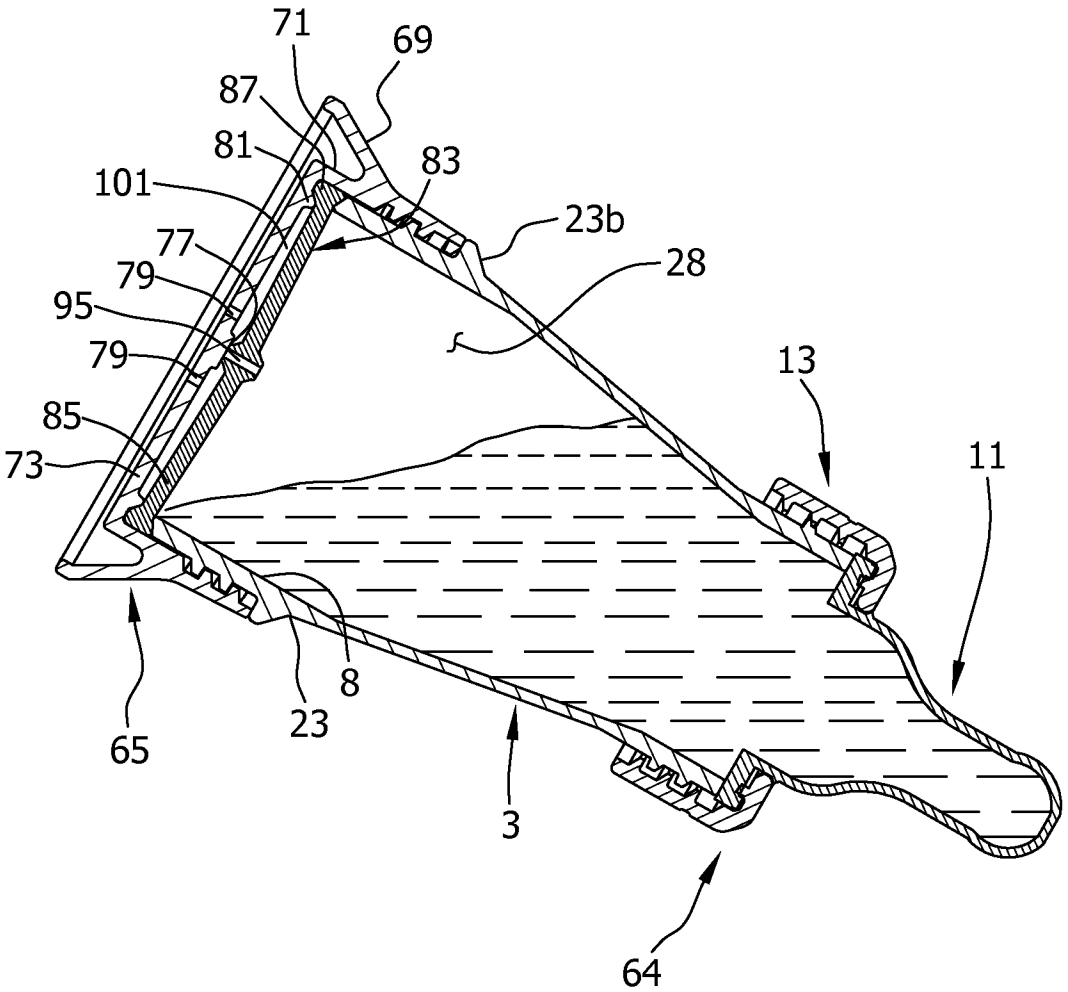
FIG. 25 is a longitudinal cross section of the bottle assembly having the liquid therein and the diaphragm returned to its sealed position with respect to the bottom closure member, the bottle assembly being shown in its tilted, drinking position.

As illustrated in FIG. 25, air is trapped in the air passage 95 in the diaphragm 83 when the outer facing one of the first and second sealing elements 91, 93 of the diaphragm 83 is sealingly seated against the seat 77 of the base panel 73 of the bottom closure member 65. This trapped air inhibits liquid contained in the liquid chamber 28 of the bottle 3 from entering the air passage 95 in the diaphragm. Inhibiting liquid from entering the air passage 95 in the diaphragm 83 significantly reduces the likelihood that liquid contained in the liquid chamber 28 of the bottle 3 will leak from the bottle assembly 1.

Figure 26:
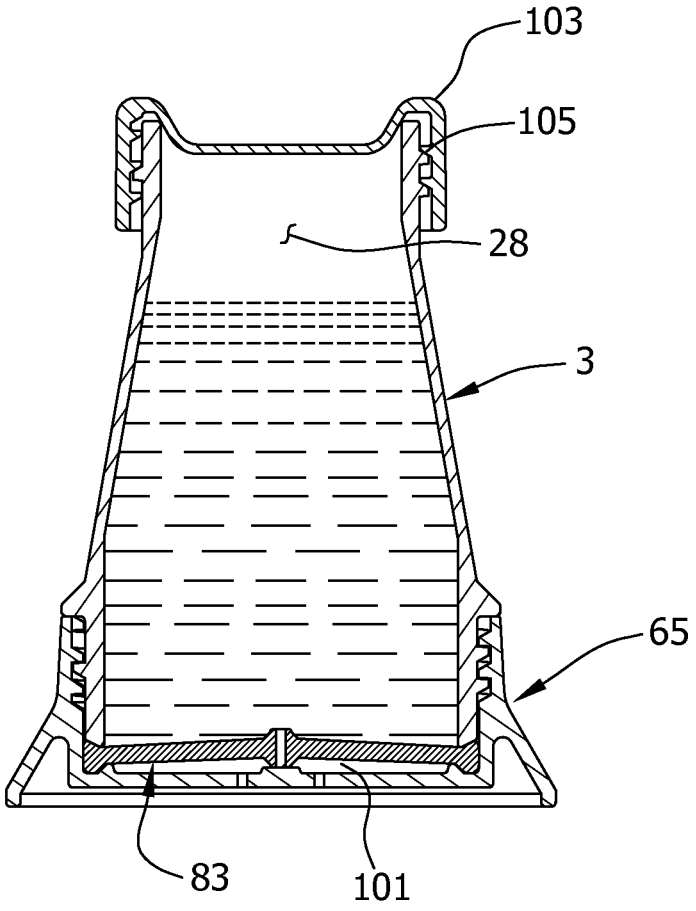
FIG. 26 is a vertical cross section of the bottle assembly in a storage configuration for storing a liquid therein.
Figure 27:
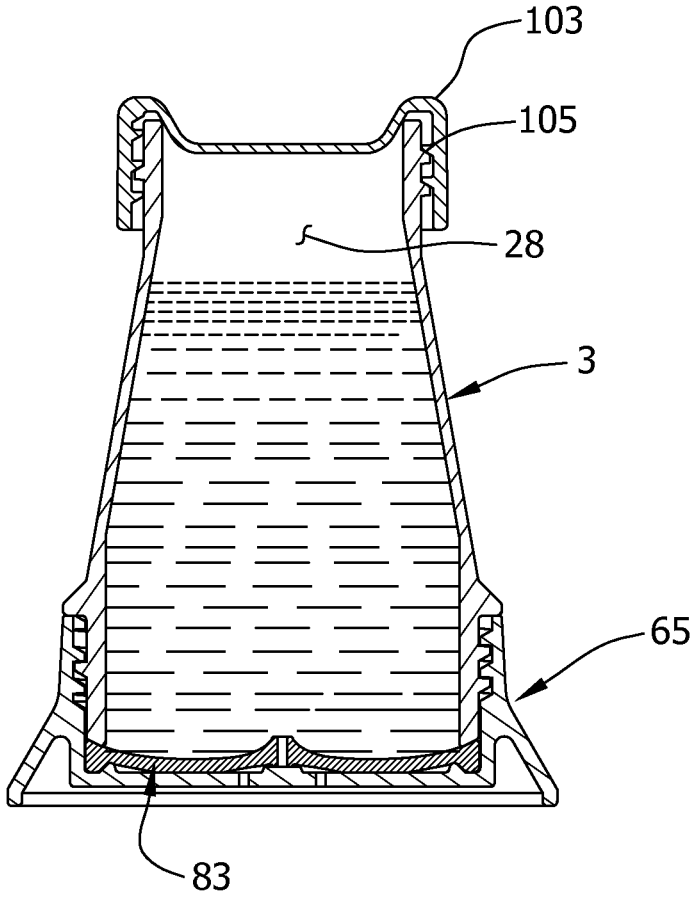
FIG. 27 is a vertical cross section similar to FIG. 26 but with the liquid therein being frozen.

FIGS. 26 and 27 illustrate the bottle assembly 1 in a storage configuration. In this configuration, the cover 9, nipple 11, and collar 13 are removed from the bottle assembly 1 and replaced with a cap 103. The cap 103 includes internal threads 105 configured for sealingly engaging with the external threads 27 on the top portion 10 of the bottle. FIG. 26 illustrates the bottle assembly 1 being used to store a liquid. Thus, the bottle assembly 1, in its storage configuration, can be used to store a liquid, e.g., breast milk or formula, at room temperature or in a refrigerator. The bottle assembly 1 can also be used in this configuration as a suitable container to transport a liquid. For example, the bottle assembly 1 in its storage configuration can be filled with a liquid, sealed with the cap 103, and placed in a diaper bag or other suitable receptacle for later use.

FIG. 27 illustrates the bottle assembly 1 being used to store a frozen liquid. In one suitable use, the bottle assembly 1 can be used in its storage configuration to freeze breast milk, which is a common practice among breast feeding mothers.

When a liquid contained in the liquid container 28 of the bottle 3 freezes, it expands. This expansion, as illustrated in FIG. 27, causes the diaphragm 83 to deflect downward into the air gap 101 and toward the base panel 73 of the bottom closure member 65. It is understood that the bottle assembly 1 can be used to store any suitable liquid whether in a liquid state or a frozen state.

As various changes could be made in the above constructions and methods without departing from the scope of the invention, it is intended that all matter contained in the above description and shown in the accompanying drawings shall be interpreted as illustrative and not in a limiting sense.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A bottle assembly having a bottom vent, the assembly comprising:

a bottle defining a liquid chamber for holding a quantity of liquid, the bottle having an open bottom, an open top, and a sidewall extending between the open bottom and the open top, the sidewall having a top portion, a base portion, and middle portion extending between the top and base portions;

a top closure member adapted for releasable engagement with the top portion of the bottle for closing the open top of the bottle, the top closure member having an opening for allowing liquid held in the liquid chamber to exit the bottle assembly;

a bottom closure member adapted for releasable engagement with the base portion of the bottle for closing the open bottom of the bottle; the bottom closure member having a base panel with at least one aperture therein; and a diaphragm positionable between the bottom closure member and the base portion of the bottle, the diaphragm having at least one sealing element for sealingly engaging the base panel of the bottom closure member and an air passage extending through the at least one sealing element, the diaphragm being exposed to the liquid when liquid is held in the liquid chamber, the diaphragm being moveable between a sealed position wherein the at least one sealing element is sealingly engaged with base panel of the bottom closure member and an unsealed position wherein the at least one sealing element is at least partially disengaged from the base panel of the bottom closure member for allowing air to pass through the air passage of the diaphragm and into the liquid chamber of the bottle, the diaphragm being bowed upward proximate the at least one sealing element for biasing the at least one sealing element against the base panel when in the sealed position, the air passage being configured to inhibit liquid contained within the liquid chamber of the bottle from entering the air passage when the diaphragm is in its sealed position by trapping air within the air passage.

2. The bottle assembly as set forth in claim 1 wherein the base panel of the bottom closure member is generally flat.

3. The bottle assembly as set forth in claim 1 wherein the bottom closure member comprises a seat disposed on the base panel, the seat being configured for engagement with the at least one sealing element of the diaphragm.

4. The bottle assembly as set forth in claim 3 wherein the base panel includes two apertures, each of the apertures being located generally adjacent to the seat.

5. The bottle assembly as set forth in claim 3 wherein the base panel includes an annular shoulder spaced from the seat, the annular shoulder and seat being configured to support the diaphragm.

6. The bottle assembly as set forth in claim 1 wherein the bottom closure member comprises a foot for providing stability to the bottle assembly when the bottle assembly is placed on a generally flat surface.

7. The bottle assembly as set forth in claim 1 wherein the top closure member comprises a nipple and a collar, the collar being adapted to selectively attach the nipple to the top portion of the bottle.

8. The bottle assembly as set forth in claim 1 wherein the diaphragm comprises a roughly disk-shaped portion and an annular rim depending from the disk-shaped portion.

9. The bottle assembly as set forth in claim 8 wherein the diaphragm has a first side and a second side, each side of the diaphragm having a sealing element disposed thereon.

10. The bottle assembly as set forth in claim 9 wherein the diaphragm is substantially symmetric such that the diaphragm is positionable in the bottom enclosure with either one of the sides being exposed to the base portion of a bottle.

11. A bottle assembly having a bottom vent, the assembly comprising:

a bottle defining a liquid chamber for holding a quantity of liquid, the bottle having an open bottom, an open top, and a sidewall extending between the open bottom and the open top, the sidewall having a top portion, a base portion and middle portion extending between the top and base portions;

a cap for attaching to the top portion of the bottle;

a bottom closure member adapted for releasable engagement with the base portion of the bottle for closing the open bottom of the bottle; the bottom closure member having a base panel with at least one aperture therein;

a diaphragm positionable between the bottom closure member and the base portion of the bottle, the diaphragm having at least one sealing element for sealingly engaging the base panel of the bottom closure member and an air passage extending through the at least one sealing element, the diaphragm being exposed to liquid when liquid is held in the liquid chamber, the diaphragm being moveable between a sealed position wherein the at least one sealing element is sealingly engaged with the base panel of the bottom closure member and an unsealed position wherein the at least one sealing element is at least partially disengaged from the base panel of the bottom closure member for allowing air to pass through the air passage of the diaphragm and into the liquid chamber of the bottle; and a gap formed between the diaphragm and the base panel of the bottom closure member, wherein the diaphragm is configured to deflect downward into the gap upon freezing of the liquid held in the liquid chamber of the bottle, such that the at least one sealing element is sealingly engaged with the base panel of the bottom closure member.

12. The bottle assembly as set forth in claim 11 wherein the base panel of the bottom closure member is generally flat.

13. The bottle assembly as set forth in claim 11 wherein the bottom closure member comprises a seat disposed on the base panel, the seat being configured for engagement with the at least one sealing element of the diaphragm.

14. The bottle assembly as set forth in claim 13 wherein the base panel has a plurality of apertures therein, each of the apertures being disposed generally adjacent the seat.

15. The bottle assembly as set forth in claim 13 wherein the base panel has an annular shoulder spaced inward from the cylindrical wall of the bottom closure, the annular shoulder and seat being configured to support the diaphragm.

16. The bottle assembly as set forth in claim 15 wherein the diaphragm has a disk-shaped portion and an annular rim depending from the disk-shaped portion, the annular rim being disposed between the annular shoulder of the base panel of the bottom closure member and the cylindrical wall of the bottom closure member.

17. The bottle assembly as set forth in claim 11 wherein the bottom closure member comprises a cylindrical wall extending upward from the base panel, the cylindrical wall and the base panel collectively defining a cup-shaped socket.

18. The bottle assembly as set forth in claim 17 wherein the bottom closure member further comprises a tapered foot extending downward and outward from the socket.

19. The bottle assembly as set forth in claim 11 wherein the at least one sealing element is generally frustum.

20. The bottle assembly as set forth in claim 19 wherein the diaphragm has two axially aligned sealing elements, one of the sealing elements being located on one side of the diaphragm and the other sealing element being located on the other side of the diaphragm.

21. The bottle assembly as set forth in claim 20 wherein the two sides of the diaphragm are substantially identical to each other.

22. A method of venting a bottle assembly having a bottom vent, the method comprising:

attaching a bottom closure member to a base portion of a bottle to thereby close an open bottom of the bottle, wherein a diaphragm is captured between the bottom closure member and the base portion of the bottle, the diaphragm having at least one sealing element for sealingly engaging a base panel of the bottom closure member and an air passage extending through the at least one sealing element, the diaphragm being bowed upward proximate the at least one sealing element for biasing the at least one sealing element against the base panel;

placing a liquid into a liquid chamber of the bottle;

attaching a top closure member to a top portion of the bottle to thereby close an open top of the bottle, the top closure member having an opening therein;

drawing liquid through the opening in the top closure member thereby creating a vacuum within the liquid chamber, the vacuum causing the diaphragm to flex from a sealed position wherein the at least one sealing element is in sealing engagement with the base panel of the bottom closure member to an unsealed position wherein the at least one sealing element is at least partially disengaged from the base panel of the bottom closure member for allowing air to pass through the air passage of the diaphragm and into the liquid chamber of the bottle, as the vacuum within the liquid chamber of the bottle approaches ambient pressure the diaphragm moves back to the sealed position thereby preventing further air flow into the liquid chamber and trapping air within the air passage of the diaphragm to inhibit liquid contained within the liquid chamber of the bottle from entering the air passage.

23. The method as set forth in claim 22 wherein more than 50% of the surface area of one side of the diaphragm is subjected to the vacuum within the liquid chamber of the bottle and more than 50% of the surface area of the other side of the diaphragm is subjected to ambient pressure.

24. The method as set forth in claim 23 wherein more than 75% of the surface area of one side of the diaphragm is subjected to the vacuum within the liquid chamber of the bottle and more than 75% of the surface area of the other side of the diaphragm is subjected to ambient pressure.

25. A method of storing liquid in a bottle assembly, the method comprising:

attaching a bottom closure member to a base portion of a bottle to thereby close an open bottom of the bottle, wherein a diaphragm is captured between the bottom closure member and the base portion of the bottle, the diaphragm having at least one sealing element for sealingly engaging a base panel of the bottom closure member and an air passage extending through the at least one sealing element, a gap being formed between the diaphragm and the base panel of the bottom closure member;

placing a liquid into a liquid chamber of the bottle;

attaching a cap to a top portion of the bottle to thereby close an open top of the bottle;

freezing the liquid within the liquid chamber of the bottle, the diaphragm being deflected downward into the air gap such that the at least one sealing element is sealingly engaged with the base panel of the bottom closure member as a result of the liquid freezing.

* * * * *